US006565495B2

(12) United States Patent
Slattery

(10) Patent No.: US 6,565,495 B2
(45) Date of Patent: May 20, 2003

(54) ERGONOMIC WEIGHTLIFTING BENCH

(76) Inventor: J. Patrick Slattery, 484 Whetstine Ave., Prescott, AZ (US) 86301

( * ) Notice: Subject to any disclaimer, the term of this patent is extended or adjusted under 35 U.S.C. 154(b) by 0 days.

(21) Appl. No.: 09/783,153

(22) Filed: Feb. 14, 2001

(65) Prior Publication Data

US 2002/0111258 A1 Aug. 15, 2002

(51) Int. Cl.[7] ..... A63B 26/00

(52) U.S. Cl. ..... 482/142; 482/148; 482/907; 482/908

(58) Field of Search ..... 482/142, 148, 482/907, 908

(56) References Cited

U.S. PATENT DOCUMENTS 4,830,367 A * 5/1989 Foran ..... 272/145
5,160,305 A * 11/1992 Lin ..... 482/138
5,277,684 A * 1/1994 Harris ..... 482/130
5,722,921 A * 3/1998 Simonson ..... 482/100
6,264,586 B1 * 7/2001 Webber ..... 482/104

* cited by examiner

*Primary Examiner*—Nicholas D. Lucchesi
*Assistant Examiner*—Lori Baker Amerson
(74) *Attorney, Agent, or Firm*—The Winarski Firm, PLLC

(57) ABSTRACT

An ergonomically designed weightlifting bench that is provided with an adjustable foot rest and an adjustable knee support. The bench is made of a frame that includes arms that support an Olympic or other weightlifting bar. A pair of pads are mounted to the top of the frame of the bench. The adjustable foot rest is mounted to the frame of the bench. The adjustable foot rest is made of an extendable arm that pivotally mounts to the frame of the bench. A foot pad is mounted at the top of the extendable arm. An adjustable knee support is provided in the center of the bench.

1 Claim, 6 Drawing Sheets

ERGONOMIC WEIGHTLIFTING BENCH

FIELD OF THE INVENTION

The present invention relates to the field of devices used to assist weightlifters in performing weightlifting exercises and more specifically to ergonomically designed bench presses that are provided with an adjustable foot support.

BACKGROUND

Weightlifting is a very popular sport and form of exercise in our society today. One of the most common devices that weightlifters use while weightlifting is a bench. The bench essentially consists of a flat board that is padded with foam and covered in vinyl or leather. One or more pairs of metal legs raise the padded board off the ground. Typically there are supports that extend from one end of the bench that hold an Olympic barbell. In this configuration, the weightlifter can perform a bench press that exercises the chest, triceps, and shoulders.

To perform a bench press exercise, the weightlifter will place his or her back flat on the bench. In the bench presses that typically exist on the market today, the weightlifter would then place his or her feet on the floor. In order to place his or her feet on the floor, typically the weightlifter has to naturally arch his or her spine. This arch can greatly increase while the weightlifter is performing the bench press exercise. The arching of the spine prevents the weightlifter from correctly performing the bench press exercise. In addition, the weightlifter could arch his or her back to a point where it injures his or her spine such as a fractured vertebrae or ruptured disc. Therefore, it is highly desirable to find a device or method that could enable the weightlifter to lie flat on a bench without arching his or her spine. Serious back injuries may require extensive surgery. Damage to the spinal nerve is typically incurable.

At present, many weightlifters try to avoid arching their spine during bench press exercises by place their feet on the edge of the bench. By placing their feet on the edge of the bench, the weightlifter's spine does not become arched during the bench press exercise. However, this solution has several faults and limitations. First, weightlifting benches are typically one foot wide and three and one half feet long. Many weightlifters, especially those individuals who have large physiques, are unable to securely place their feet on the edge of the bench. This problem prevents the weightlifter from optimally performing the bench press exercise in a comfortable manner. Also, the weightlifter's feet may easily slip off the end of the bench.

One device that attemps to address the problem of weightlifters arching their spines on the bench is a metal bar that is attached to the edge of the bench where the weightlifter's feet are located. This metal bar extends outward on both sides of the bench. The weightlifter places his feet on this bar thereby preventing the weightlifter from arching his back. However, in this design, the metal bar is permanently fixed to the bench. Therefore, it is not possible to alter the position of the metal bar so those individuals of differing physiques can use the bench in the most comfortable and secure manner. Further, the metal bar serves as a solution to the spine-arching problem only when the weightlifter is using the bench for bench press exercises. However, weightlifters use benches for many other exercises other than just the bench press exercise and may periodically find a permanently fixed bar to be an obstruction.

Many bench presses are designed so that it is possible to reconfigure the bench for use in performing sit-up exercises to workout the abdominal muscles. In addition, many benches can be reconfigured to perform decline bench press exercises to exercise the lower chest. In these various other exercises, the permanently fixed metal bar does not suitably solve the spine-arching problem.

SUMMARY OF THE INVENTION

The present invention is an ergonomically designed weightlifting bench. The weightlifting bench is provided with an adjustable footrest that changes the position of the weightlifter's spine. While lying on the bench, the weightlifter places his or her feet on the adjustable footrest. This adjustment allows the weightlifter to lie on the bench without their back becoming naturally arched from having his or her feet on the floor.

The adjustable footrest is made of an outer steel shaft that is attached at its bottom end to a rotating joint. A second inner steel shaft fits inside the outer steel shaft such that the inner steel shaft can slide in and out of the outer steel shaft. The inner steel shaft has a series of holes formed along one side. The outer steel shaft is provided with pin that engages the holes formed in the side of the inner steel shaft thereby locking the inner steel shaft in place. This pin may be spring-loaded for safety. Therefore, the inner steel shaft cannot slide with respect to the outer steel shaft when the pin is in engagement with one of the holes formed in the side of the inner steel shaft. In order to slide the inner steel shaft with respect to the outer steel shaft, it is necessary to pull the pin out such that the pin no longer engages one of the holes formed in the side of the inner steel shaft.

A footrest is pivotally mounted to the top of the inner steel shaft. Therefore, by sliding the inner steel shaft with respect to the outer steel shaft, it is possible to adjust the height of the footrest to accommodate weightlifters having various physiques. The footrest is pivotally mounted so that the footrest rotates to naturally conform to the angle of the weightlifter's foot. A strap may be attached to the footrest to so that the weightlifter can securely mount his feet to the footrest. The use of the strap is important when the bench is used for sit-up exercises or decline bench press exercises.

The rotating joint that is attached to the bottom end of the outer steel shaft is fixed to the bench. A semicircular plate is fixed to the bench between the bench and the outer steel shaft. A series of holes is formed near the edge of the semicircular plate. A second pin, which may also be spring-loaded, is secured to the outer steel shaft such that the pin engages the holes formed in the semicircular plate. When the second spring-loaded pin is pulled out, the outer steel shaft is free to pivot about the rotating joint. However, when the pin is engaged to one of the holes in the semicircular plate, the outer steel shaft is fixedly held in a fixed position with respect to the bench.

The bench is made of two padded boards, a lower board and an upper board, that are hinged together at the center. A lower support is fixedly mounted to the lower board at the end of the lower board opposite to the end that is hinged to the upper board. The support raises the board off of the ground. The adjustable footrest is fixedly mounted to this lower support. An upper support is mounted to the upper board at the end of the upper board opposite of the end hinged to the lower board. This upper support raises the bench off of the ground. The upper support includes a pair of adjustable arms that support an Olympic or other bar. The arms are adjustable to raise and lower the height of the Olympic or other bar with respect to the bench.

The lower board is held in a fixed position by the lower support. The end of the upper board that is hinged to the lower board is held at a fixed height by the lower board. However, the end of the upper board opposite to the hinged end called the distal end is free to pivot about the hinged end. The distal end of the upper board can therefore be raised and lowered in height. The weightlifter can therefore raise the unhinged end of the upper board to a position flat with the lower board for a flat bench exercise. In addition, the weightlifter can raise the distal end of the upper board to a position higher than the lower board for performing bench press exercises. Still further, the weightlifter can lower the distal end of the upper board below the height of the lower board so that he can perform decline bench press exercises.

A padded knee rest can be mounted to the bench at the hinged point of the bench. In combination with the upper board placed in a lowered position, the weightlifter can perform sit-ups on the bench with the use of the padded knee rest. The footrest with foot straps will help secure the body of the weightlifter while he or she performs sit-ups or decline bench press exercises.

As stated above, the bench in this application can be configured to perform various weightlifting exercises. The footrest can provide ample foot support to the weightlifter during these exercises due to the fact that it is adjustable.

The primary object of this invention is to provide a footrest to a weightlifting bench to mitigate weightlifters from inappropriately arching their back. A further object of the invention is to provide a footrest that is adjustable in multiple degrees of freedom so that weightlifters that having varying physiques can use the footrest in an optimal position. Another object of the invention is to provide a bench that can be reconfigured for use with different exercises. A still further object of the invention is to provide an adjustable footrest that weightlifters can use with the bench in various configurations for different exercises. An additional object of the invention is to provide an adjustable footrest that is highly durable and easy to manufacture. Another object of the invention is to provide a footrest that has straps for use in performing decline sit-ups and decline bench exercises. Yet another object is to provide a knee rest for each knee.

Further objects and advantages of the invention will become apparent as the following description proceeds and the features of novelty which characterize this invention are pointed out with particularity in the claims annexed to and forming a part of this specification.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings wherein:

DESCRIPTION OF THE PREFERRED EMBODIMENTS

Figure 1:
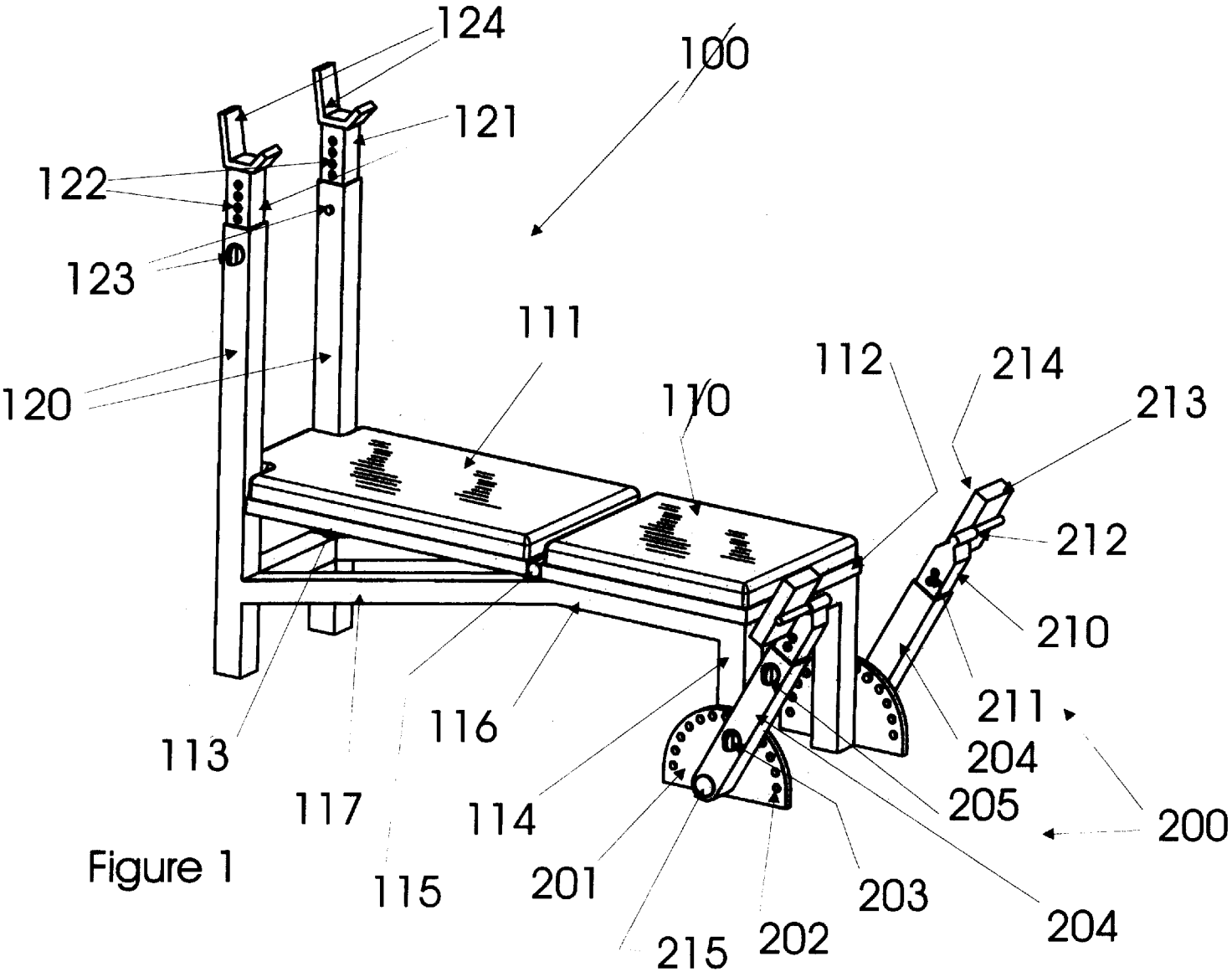
FIG. 1 shows a perspective view of the bench without foot straps.

Referring to the figures by characters of reference, FIG. 1 shows a perspective view of the ergonomically designed weightlifting bench 100 herein referred to as the bench 100. The bench 100 includes an upper padded backrest 111 and a lower pad 110 that are mounted to an upper frame 113 and a lower frame 112 respectively. The upper frame 113 is pivotally mounted to the lower frame 112 by a joint 115. The lower frame 112 is fixedly mounted to a lower beam 116. The lower beam 116 is fixedly mounted to support 114. Lower beam 116 is fixedly mounted to an upper beam 117. The upper beam 117 is then fixedly mounted to a pair of support arms 120. The support arms 120, beams 116 and 117, and support 114 form the support structure that lifts bench 100 off of the floor. In addition, the support arms also support an Olympic weightlifting bar. The support arms 120 are hollow. A bar shaft 121 slides within each of support arms 120. Each bar shaft 121 has a series of holes 122 formed along an axis. A hole is formed in support arms 120 so that a pin 123 may individually pass through each of support arms 120 and engage one of the holes 122 thereby locking bar shaft 121 in a fixed position relative to the support arm 120. When the pin 123 is pulled away from the bar shaft 121, the bar shaft 121 is free to slide within the support arm 120. The series of holes formed along the bar shaft 121 enable the bar shaft 121 to be raised or lowered to a desired height and then locked into a fixed position by pin 123. This feature enables the height of an Olympic bar held within a bar holder 124 to be adjusted relative to the bench 100. The bar holder 124 is fixedly mounted at the top of the bar shaft 121. The bar holder 124 is configured to receive the Olympic or other weightlifting bar. In an exercise, a weightlifter would place the Olympic weightlifting bar onto the bar holders 124. The weightlifter would then lie on the upper and lower pads 111 and 110 and then perform the exercise.

It is important to note that the upper frame 113 is not rigidly connected to the support arms 120 or upper beam 117. The upper frame is only pivotally connected to the lower frame 112. This feature allows the upper frame to be lowered to a decline position shown in FIG. 5 or raised to an incline position (not shown). The upper frame 113 is held in a fixed position, either the horizontal position shown in FIGS. 1 and 2, or the decline position shown in FIGS. 4 and 5, by a pin that rigidly engages the upper frame 113 to the support arms 120.

In a preferred embodiment, the frame 112 and 113, beams 116 and 117, and supports 114 and 120 are made of steel. In addition, it is preferred that the bar holder 124, bar shaft 121, and joint 115 are also made of steel. In the preferred embodiment, the pads 111 and 110 are made of foam pads covered by vinyl, leather, or another similar material.

The foot support 200 is the key part of this invention. A pair of foot supports 200 provides support to the feet of a weightlifter while he or she is lying on the pads 110 and 111 of bench 100, thereby enhancing the ergonomic design of the bench 100. Each foot support 200 is rigidly attached to the bench 100 at the base of support 114. Each foot support 200 includes a plate 201 formed in the shape of a semi-circle. A series of holes 202 are formed along the circular edge of each plate 201. Holes 202 in semi-circular plate 201 could equally be radial slots, but holes are preferred for safety. A footrest arm 203 is pivotally mounted to each plate 201 by a foot rest joint 215. A hole is formed in the foot rest arm 203 so that a pin 204 can pass through each footrest arm 203 and engage one of holes 202 in plate 201. When each pin 204 is pulled away from its respective plate 201, each footrest arm 203 is free to pivot about joint 215. This features enables the angular position of the footrest 200 to change thereby allowing the footrest 200 to accommodate weightlifters of varying heights.

The footrest arm 203 is hollow. A footrest shaft 210 slides within the footrest arm 203. A series of holes 211 are formed in the footrest shaft 210 along an axis. In addition, a hole is formed within the footrest arm 205 allowing pin 205 to pass through footrest arm 205 and engage the holes 211 formed in the footrest shaft 210. When the pin 205 is in engagement with footrest arm 203 and footrest shaft 210, the footrest shaft 210 is locked into a fixed position relative to the footrest arm 203. By removing the pin 205 from engagement with holes 211, it is possible to radially extend or retract the amount of the footrest shaft 210 that extends out beyond the footrest arm 203. Once the footrest shaft 210 has been extended a desired amount, each pin 205 can be re-engaged with holes 211 thereby locking each footrest shaft 210 in a fixed position.

A footpad 213 is pivotally mounted to its respective footrest shaft 210 by joint 212. The pivotal mounting of each footpad 213 enables the footpad 213 to freely pivot to an angle that matches the position of the weightlifter's feet. The footpad 213 is a rigid plane that has a foot grip 214 mounted on the top surface. Foot grip 214 is preferably rubber, but may be another elastomeric or high friction substance which helps to keep the weightlifters feet from sliding off foot pads 213. The foot grip 214 is provided to enhance the ability of a weightlifter to comfortably maintain his or her feet on the footrest 214.

Figure 2:
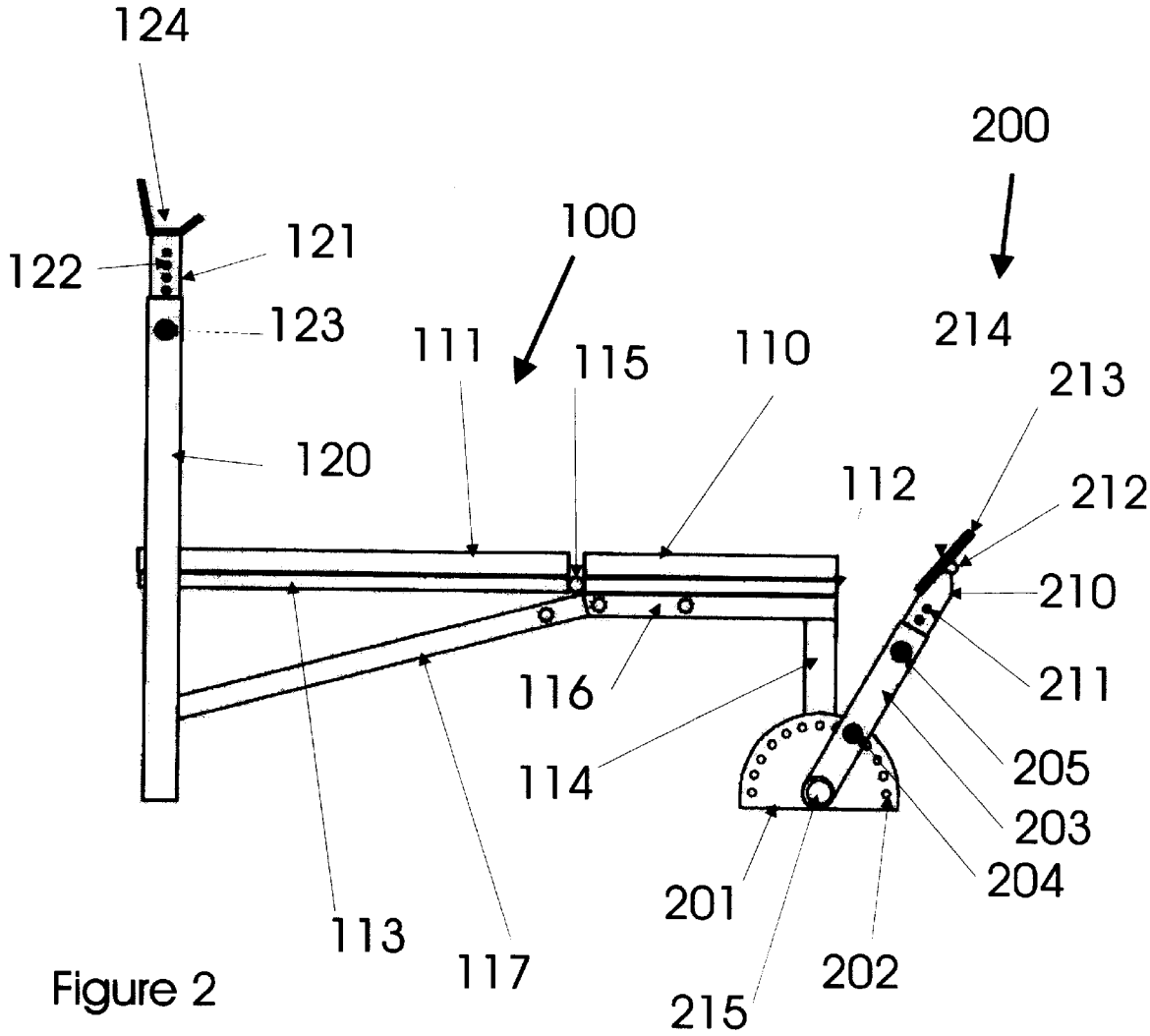
FIG. 2 shows a side view of the bench.

A side view of the bench 100 and foot support 200 are shown in FIG. 2. In this figure, the upper back rest 111 is shown in the horizontal position. The upper backrest 111 is held in this horizontal position by the pin that engages the upper back rest 111 to the support arms 120. It is possible to disengage this pin from the upper backrest 111 and support arms 120 and lower the upper backrest 111 to a position where it lies against beam 117. When the upper backrest is in this lowered position, a weightlifter can perform decline bench press exercises as well as various abdominal exercises.

Figure 3:
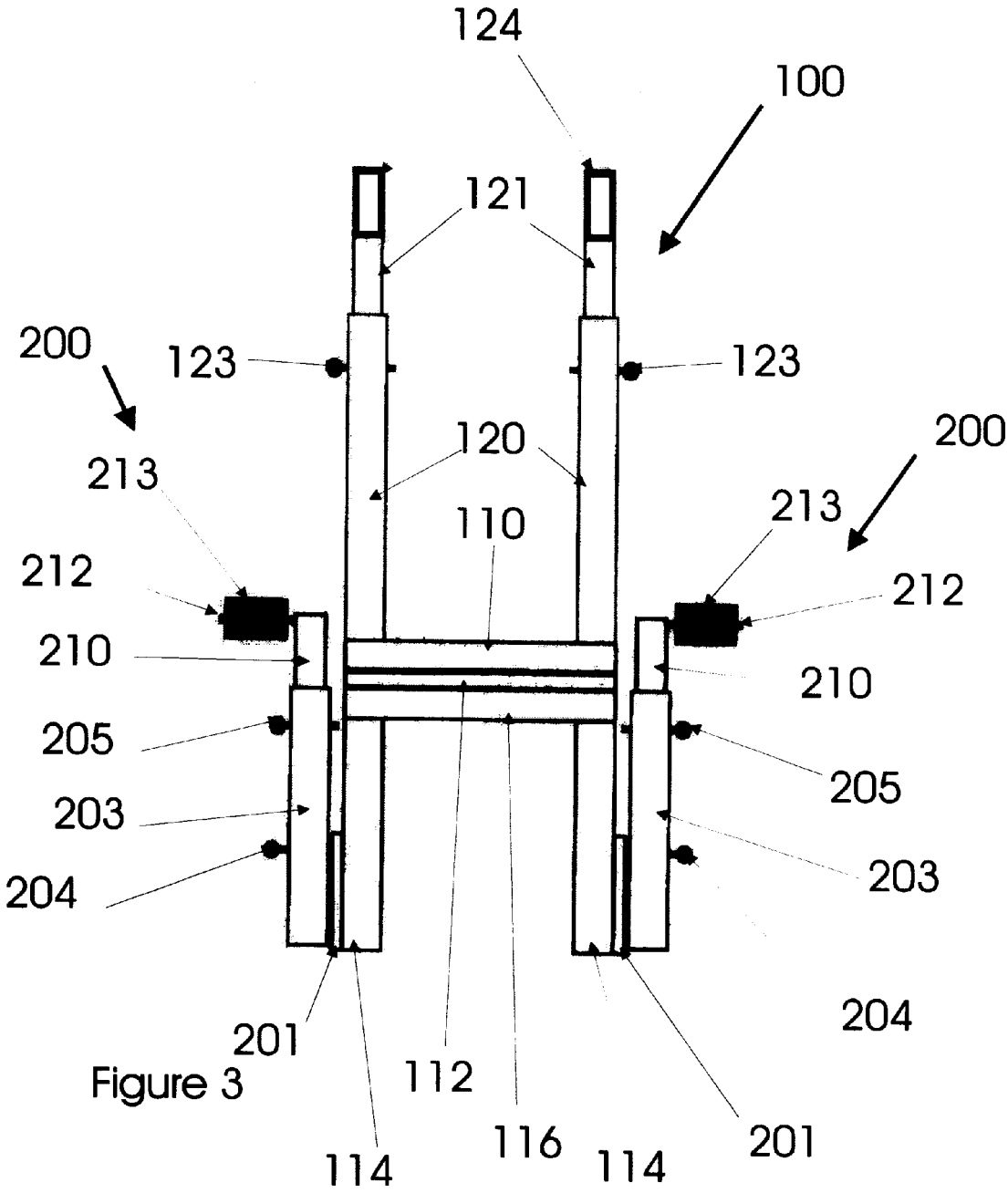
FIG. 3 shows a front view of the bench.

A front view of the bench 100 and footrest 200 is shown in FIG. 3. In this figure, the support arms 120 are shown mounted close to the pad 110 frame 112 and beam 116. In this compact configuration, the bench 100 is intended for personal home use. In a commercial version of the bench 100, the support arms 120 are distanced further apart thereby providing greater stability.

Referring again to FIG. 3, the Olympic barbell used in bench press exercises is supported by the two bar supports 124. The bar shafts 121 can be raised or lowered when the pins 123 are pulled out from engagement with the bar shafts 121. In FIG. 3, the pins 123 are shown in full engagement locking bar shafts 121 in a fixed position relative to the support arms 120.

The are two footrests 200, one for each foot. Both footrest assemblies 200 are comprised identical components. However, one footrest 200 is configured for the left foot and the other footrest 200 is configured for the right foot. Foot rests 200 are independently adjusted, but are typically set to the same angular and radial position.

Figure 4:
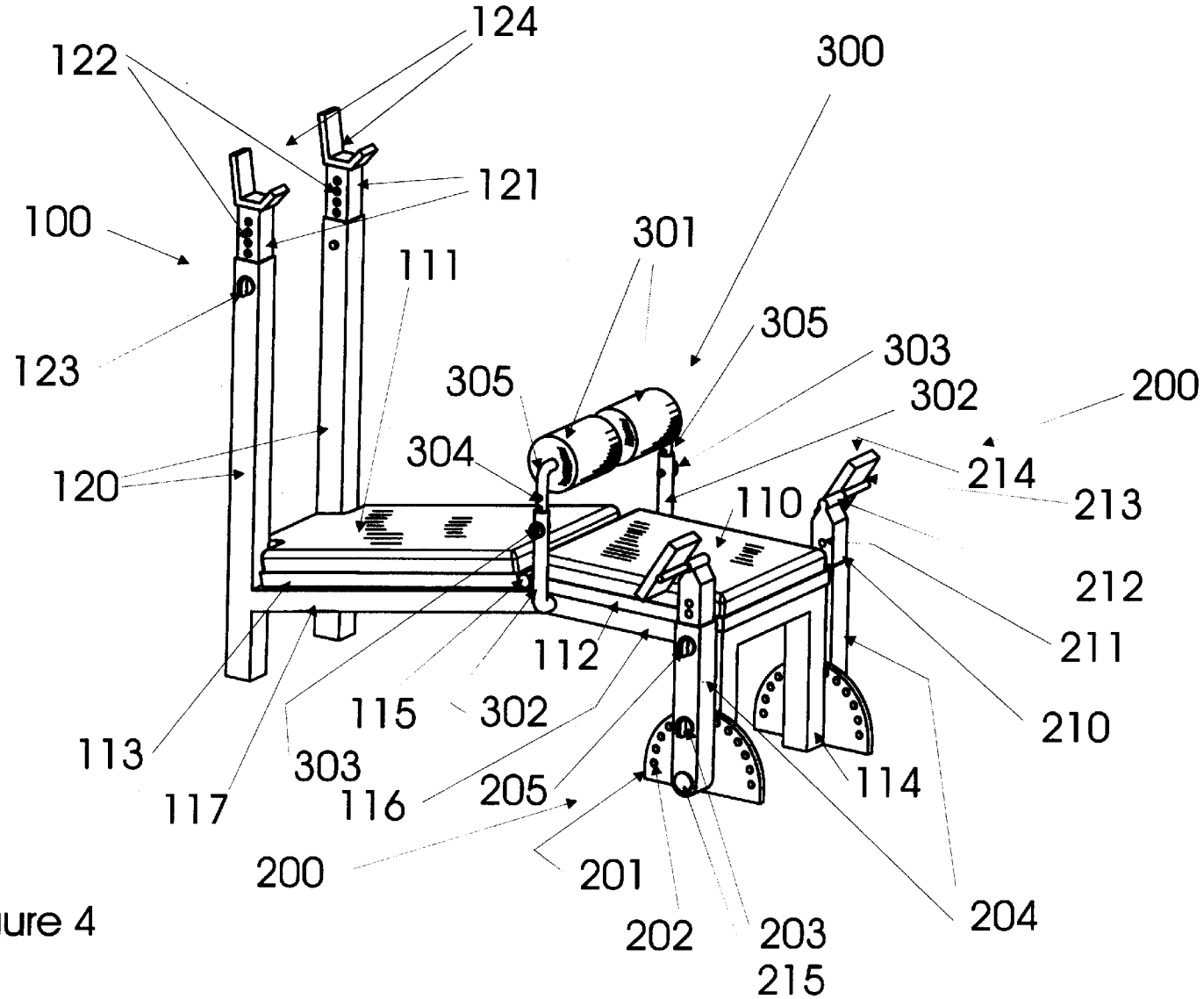
FIG. 4 shows a perspective view of the bench with knee supports and foot straps attached.

FIG. 4 shows a perspective view of a knee support assembly 300 mounted to the bench 100. The knee support assembly 300 enables weightlifters to perform a greater variety of exercises on the bench 100. The knee support assembly 300 is a removable attachment to the bench 100. The knee support assembly 300 includes a pad bar 305, a bench bar 302, and a pin 303. The bench bar 302 is fixedly bolted or otherwise secured to the bench 100. Specifically, in FIG. 4, the bench bar 302 is mounted to the lower beam 116. The bench bar 302 is hollow thereby permitting the pad bar 305 to be able to slide up and down within the bench bar 302. The pad bar 305 is designed to be moved up and down so that weightlifters can adjust the height of the pad bar 305 to fit their personal needs. The sides of the pad bar 305 have a series of holes 304 formed along an axis. The sides of the bench bar 302 have a hole formed along the same axis so that a pin 303 can slide through the bench bar 302 and engage the pad bar 305 thereby locking the pad bar 305 in a fixed position. A pair for knee pads 301 are mounted to the pad bar 305. These knee pads 301 provide cushioned support for the rear portion of the weightlifters knees.

In FIG. 4, the upper back pad 111 is shown in the decline position. The upper back pad is shown lowered against the upper beam 117. In this configuration, the weightlifter can perform decline bench press exercises. When the bench is in this configuration, the knee support 300 enhances the ergonomic design of the bench through providing knee support to the weightlifters knees. To further enhance the comfort and stability of the weightlifter lying on the bench 100, the footrest 200 is provided with a foot strap 220 that mounts to the pivotally mounted foot pad 213 thereby securely holding the weightlifters feet in position.

The knee pads 301 are formed out of a cushioned and padded for weightlifter comfort. In one embodiment, the knee pads 301 are formed from an elastomeric foam that is covered with either vinyl or leather.

Figure 5:
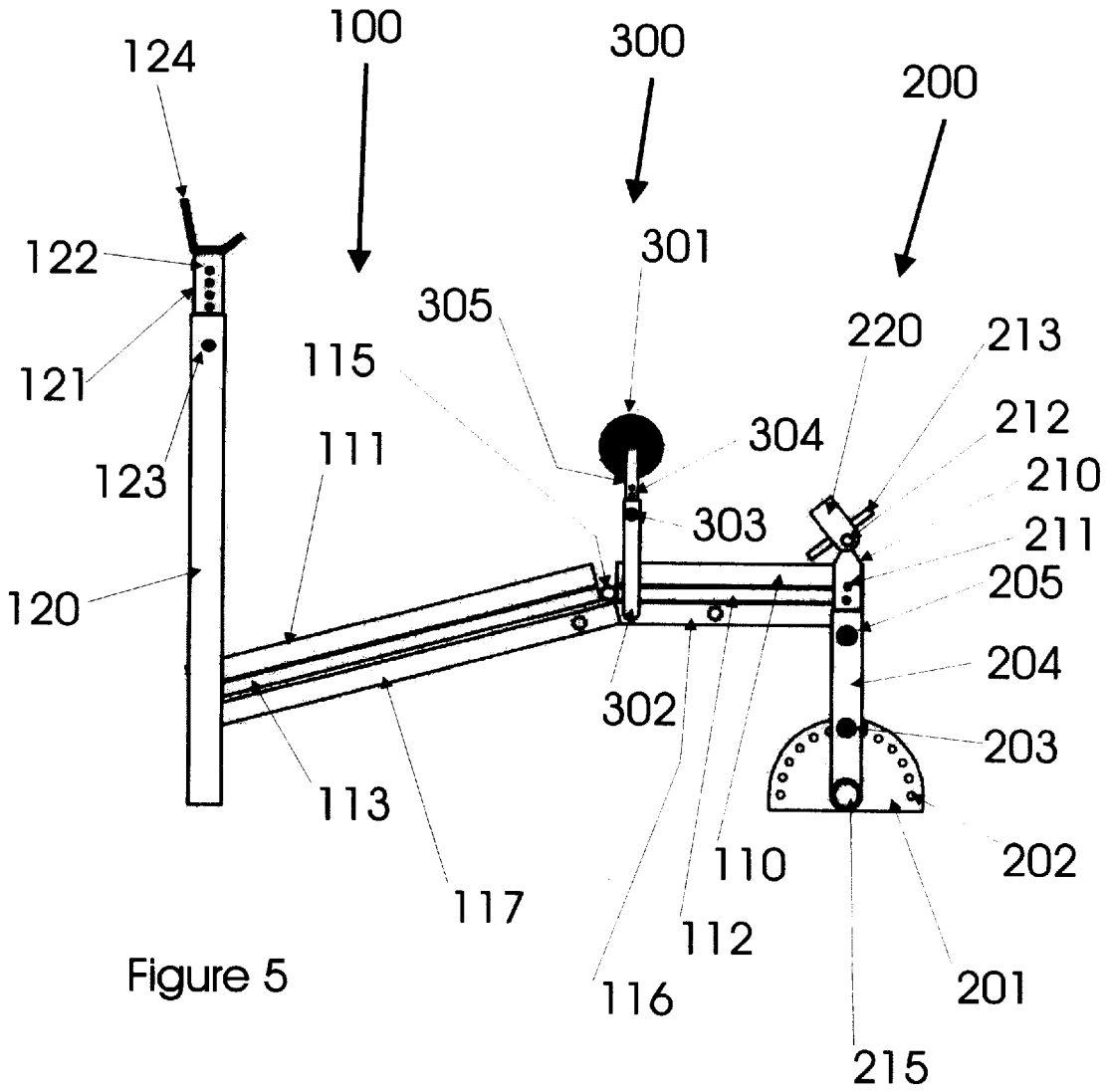
FIG. 5 shows a side view of the bench with knee supports and foot straps attached.
Figure 6:
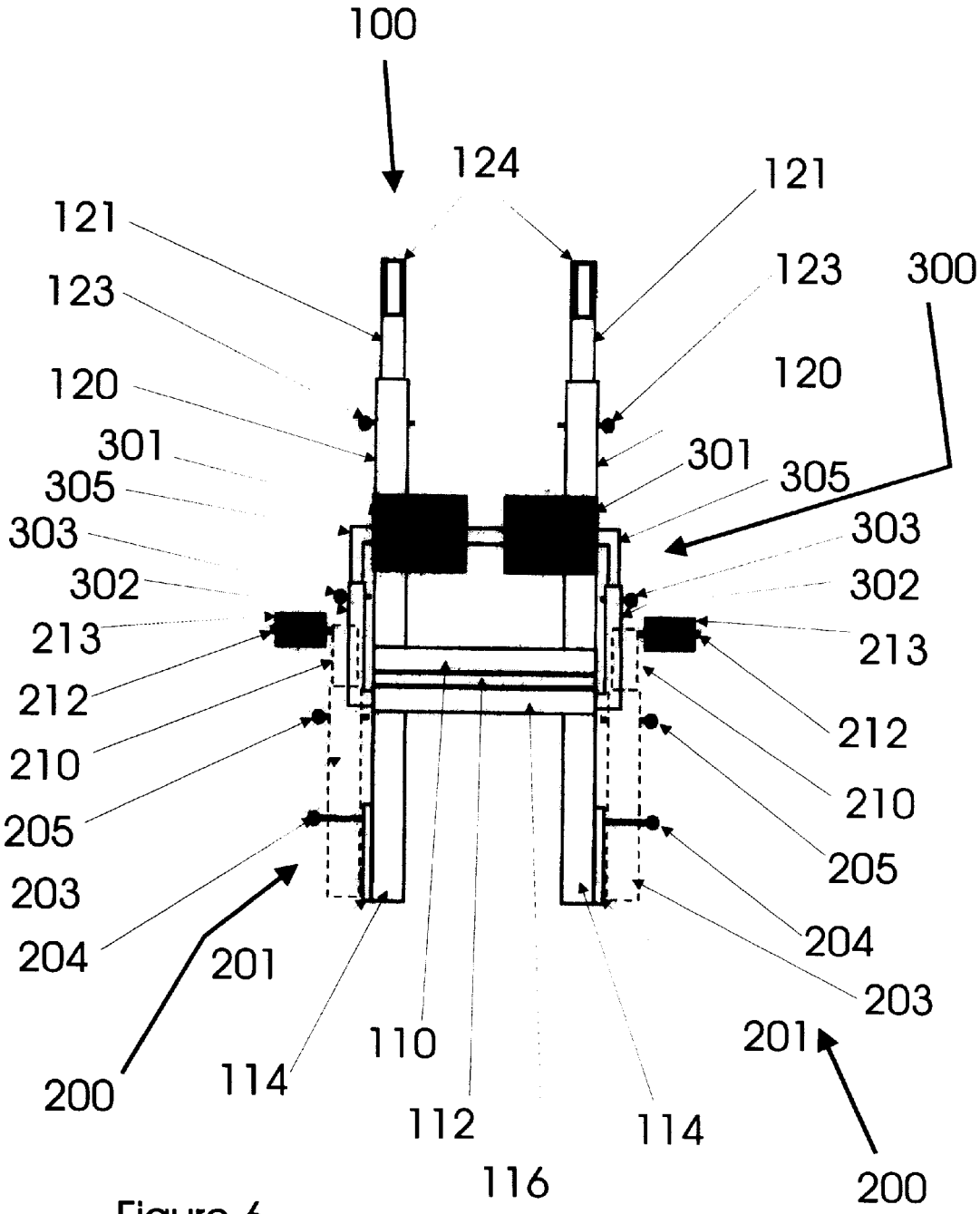
FIG. 6 shows a front view of the bench with knee supports and foot straps attached.

A side view of the bench 100 including the knee support 300 is shown in FIG. 5. A front view of the bench 100 including the knee support 300 is shown in FIG. 6. In FIGS. 4, 5, and 6, the footrest 200 is shown in an upright position. The footrest 200 is represented by dashed lines in FIG. 6 in order to better reveal the configuration of the knee support 300 comprised of the bench bar 302 and pad bar 305. As shown in FIG. 6, there are two pins 303 that engage on each side of the bench bar 302.

In a preferred embodiment, the pins 123, 203, 210, and 303 are steel pins with durable plastic handles for ease of operation.

While the invention has been shown and described with reference to a particular embodiment thereof, it will be understood to those skilled in the art, that various changes in form and details may be made therein without departing from the spirit and scope of the invention.

I claim:

1. A weightlifting bench comprised of:

a bench comprised of:

a beam;

an upper frame;

a lower frame mounted to said beam, said upper frame pivotally mounted to said lower frame;

an upper padded surface mounted to said upper frame;

a lower padded surface mounted to said lower frame;

a pair of arm supports mounted to said beam;

a footrest support mounted to said bench, wherein said footrest support is detachable from said bench, said footrest support comprised of:

a plate;

a footrest arm pivotally mounted to said plate;

a footrest shaft that is slidably mounted to said footrest arm;

a footpad, said footpad pivotally mounted to the top of said footrest shaft; and a foot grip mounted to a top surface of said footpad; and a knee support assembly vertically positioned above said bench, said knee support extendably attached to said beam proximal to the position where said upper frame pivotally mounts to said lower frame, wherein said knee support assembly is extendably attached to said beam within 0.4 meters of the position where said upper frame pivotally mounts to said lower frame, wherein said knee support assembly is comprised of:

a bench bar that fixedly mounts said knee support to said beam;

a pad bar, said pad bar slidably attaches to said bench bar;

a removable pin, said removable pin interlocks said bench bar to said pad bar thereby holding said pad bar in a fixed position relative to said bench a knee pad, said knee pad secured to said pad bar.

* * * * *